US008549860B2

(12) United States Patent
Carroni et al.

(10) Patent No.: US 8,549,860 B2
(45) Date of Patent: Oct. 8, 2013

(54) METHOD FOR COMBUSTING HYDROGEN-RICH, GASEOUS FUELS IN A BURNER, AND BURNER FOR PERFORMING SAID METHOD

(75) Inventors: Richard Carroni, Niederrohrdorf (CH); Stefano Bernero, Oberrohrdorf (CH); Fernando Biagioli, Fislisbach (CH); Thierry Lachaux, Mellingen (CH)

(73) Assignee: Alstom Technology Ltd, Baden (CH)

( * ) Notice: Subject to any disclaimer, the term of this patent is extended or adjusted under 35 U.S.C. 154(b) by 0 days.

(21) Appl. No.: 13/405,396

(22) Filed: Feb. 27, 2012

(65) Prior Publication Data

US 2012/0210727 A1 Aug. 23, 2012

Related U.S. Application Data

(63) Continuation of application No. PCT/EP2010/063461, filed on Sep. 14, 2010.

(30) Foreign Application Priority Data

Sep. 17, 2009 (CH) ..... 1438/09

(51) Int. Cl.
*F23R 3/12* (2006.01)

(52) U.S. Cl.
USPC ..... 60/737; 60/738; 60/748; 60/734

(58) Field of Classification Search
USPC ..... 60/734, 737, 738, 749, 742, 743, 60/744, 745, 746, 748, 776, 39.461, 39.465
See application file for complete search history.

(56) References Cited

U.S. PATENT DOCUMENTS

| | | | | |
|---|---|---|---|---|
| 4,932,861 | A | 6/1990 | Keller et al. | |
| 5,081,844 | A * | 1/1992 | Keller et al. | 60/737 |
| 5,307,634 | A | 5/1994 | Hu | |
| 5,375,995 | A * | 12/1994 | Dobbeling et al. | 431/8 |
| 5,584,684 | A * | 12/1996 | Dobbeling et al. | 431/285 |
| 5,735,687 | A | 4/1998 | Knoepfel et al. | |
| 5,794,449 | A * | 8/1998 | Razdan et al. | 60/737 |
| 5,797,267 | A * | 8/1998 | Richards | 60/737 |

(Continued)

FOREIGN PATENT DOCUMENTS

| | | |
|---|---|---|
| EP | 0321809 B1 | 5/1991 |
| EP | 0780629 A2 | 6/1997 |

(Continued)

OTHER PUBLICATIONS

European Patent Office, Search Report in Swiss Patent Application No. 1438/2009 (Jan. 8, 2010).

(Continued)

*Primary Examiner* — William H Rodriguez
*Assistant Examiner* — Steven Sutherland
(74) *Attorney, Agent, or Firm* — Leydig, Voit & Mayer, Ltd.

(57) ABSTRACT

A method for the combustion of hydrogen-rich, gaseous fuels in combustion air in a burner of a gas turbine includes injecting the hydrogen-rich, gaseous fuel at least partially isokinetically with respect to the combustion air such that the partially hydrogen-rich, gaseous fuel is injected at least partially in the same direction and at least partially at the same velocity as the combustion air.

24 Claims, 5 Drawing Sheets

(56) References Cited

U.S. PATENT DOCUMENTS

| | | | | |
|---|---|---|---|---|
| 5,954,490 | A * | 9/1999 | Knopfel et al. | 431/115 |
| 6,263,676 | B1 | 7/2001 | Keller | |
| 7,000,403 | B2 * | 2/2006 | Henriquez et al. | 60/776 |
| 7,013,648 | B2 * | 3/2006 | Griffin et al. | 60/737 |
| 8,104,286 | B2 * | 1/2012 | Zuo et al. | 60/748 |
| 2005/0115244 | A1 | 6/2005 | Griffin et al. | |
| 2007/0026353 | A1 * | 2/2007 | Eroglu et al. | 431/350 |
| 2008/0280239 | A1 | 11/2008 | Carroni et al. | |
| 2008/0314045 | A1 | 12/2008 | Carroni et al. | |
| 2009/0123882 | A1 | 5/2009 | Eroglu et al. | |

FOREIGN PATENT DOCUMENTS

| | | | |
|---|---|---|---|
| EP | 0981016 | A1 | 2/2000 |
| EP | 1070915 | A1 | 1/2001 |
| EP | 2058590 | A1 | 5/2009 |
| WO | WO 9317279 | A1 | 9/1993 |
| WO | WO 03098110 | A1 | 11/2003 |
| WO | WO 2006058843 | A1 | 6/2006 |
| WO | WO 2007074033 | A1 | 7/2007 |

OTHER PUBLICATIONS

European Patent Office, Inernational Search Report in International Patent Application No. PCT/EP2010/063461 (Jan. 30, 2012).

* cited by examiner

METHOD FOR COMBUSTING HYDROGEN-RICH, GASEOUS FUELS IN A BURNER, AND BURNER FOR PERFORMING SAID METHOD

CROSS-REFERENCE TO PRIOR APPLICATIONS

This application is a continuation of International Patent Application No. PCT/EP2010/063461, filed on Sep. 14, 2010 which claims priority to Swiss Patent Application No. CH 01438/09, filed on Sep. 17, 2009. The entire disclosure of both applications is hereby incorporated by reference herein.

FIELD

The present invention relates to the field of combustion technology for gas turbines. It also relates to a method for the combustion of hydrogen-rich, gaseous fuels in the burner of a gas turbine, as well as to a burner for carrying out the method.

BACKGROUND

Lowering the emission of greenhouse gases into the atmosphere will call for a major effort, especially to reduce the amount of anthropogenic $CO_2$ emissions. Approximately one-third of the $CO_2$ released by humans into the atmosphere stems from the production of energy, a process during which mostly fossil fuels are burned in power plants in order to generate electricity. Particularly the use of modern technologies as well as additional political initiatives will translate into a considerable savings potential in the energy-producing sector in terms of avoiding a further increase in $CO_2$ emissions.

A technically feasible way to reduce $CO_2$ emissions in thermal power plants consists of extracting carbon from the fuels used for combustion processes. This requires an appropriate pretreatment of the fuel involving, for example, partial oxidation of the fuel with oxygen and/or a pretreatment of the fuel with steam. Such pretreated fuels usually have a high content of $H_2$ and CO and, depending on the mixing ratios, exhibit heating values that, as rule, are below those of natural gas (NG). Consequently, such synthetically produced gases are referred to as MBtu gases or LBtu gases, depending on their heating value.

Due to their properties, such gases do not readily lend themselves for use in conventional burners designed for the combustion of natural gas of the type described, for example, in European patent specification EP 0 321 809 B1, European patent application EP 0 780 629 A2, international patent specification WO 93/17279 or European patent application EP 1 070 915 A1. In these burners, which work with a fuel premix, a conically widening vortex flow consisting of combustion air and admixed fuel is generated in the direction of flow, and this vortex flow becomes increasingly unstable in the direction of flow after exiting from the burner, preferably having been completely and homogenously mixed by means of the increasing swirling, and it then makes a transition to an annular vortex flow with backflow in the core.

SUMMARY

In an embodiment, the present invention provides a method for the combustion of hydrogen-rich, gaseous fuels in combustion air in a burner of a gas turbine. The hydrogen-rich, gaseous fuel is injected at least partially isokinetically with respect to the combustion air such that the partially hydrogen-rich, gaseous fuel is injected at least partially in the same direction and at least partially at the same velocity as the combustion air.

BRIEF DESCRIPTION OF THE DRAWINGS

The present invention will be described in even greater detail below based on the exemplary figures, which are schematic and not to scale. The invention is not limited to the exemplary embodiments. Features described and/or represented in the various figures can be used alone or combined in embodiments of the present invention. Other features and advantages of various embodiments of the present invention will become apparent by reading the following detailed description with reference to the attached drawings which illustrate the following.

DETAILED DESCRIPTION

Depending on the burner concept and as a function of the burner capacity, liquid and/or gaseous fuel is fed into the vortex flow that is forming inside a premix burner in order to create a fuel-air mixture that is as homogeneous as possible. However, as mentioned above, if, for purposes of attaining reduced $CO_2$ emissions, the objective is to use synthetically processed, gaseous fuels that have a high content of hydrogen as an alternative to or in combination with the combustion of conventional types of fuel, then special requirements will be made of the structural design of the premix burner systems employed. For instance, in order for synthesis gases to be fed into burner systems, the volume flow rate of the fuel has to be far greater than in comparable burners operated with natural gas, resulting in markedly different flow pulse conditions. Due to the high percentage of hydrogen in the synthesis gas and the associated low ignition temperature and high flame velocity of the hydrogen, the fuel has a strong tendency to react, and this increases the risk of re-ignition. In order to avoid this, the mean retention time of the ignitable fuel-air mixture in the burner should be reduced to the greatest extent possible.

Today's combustion installations for gas turbines and the like, which are designed for the combustion of hydrogen-rich fuels, are based on a pronounced dilution of diffusion flames (with inert media such as, for instance, $N_2$ and/or steam). The approach of lowering the output, that is to say, reducing the flame temperature, is also often employed. There are also efforts aimed at developing combustion systems with a lean premix combustion for hydrogen-rich fuels in order to further reduce the emissions and to minimize the use of expensive diluting media. Such systems require a high level of premixing. Unfortunately, however, the hydrogen-rich fuels are so reactive that considerable changes are necessary in order to burn these fuels safely and cleanly. These changes such as, for instance, raising the burner speed by selecting very high velocities for the fuel jets and/or for the combustion air, however, are usually incompatible with the requirements made of modern gas turbine burners, namely, low pressure losses in the burner as well as low losses in the fuel pressure.

The pursuit of the main objective regarding burners for hydrogen-rich fuels encounters the problem of safely filling the interior of the burner with the fuel in order to minimize the $NO_x$ emissions. The underlying design criteria for achieving this goal are:

- to the extent possible, the fuel should be kept away from all walls;
- the fuel has to be prevented from being trapped in any recirculation or stagnation zones;
- the vertical injection of the fuel, which is commonly done in premix burners operated with natural gas, has to be prevented.

Figure 1:
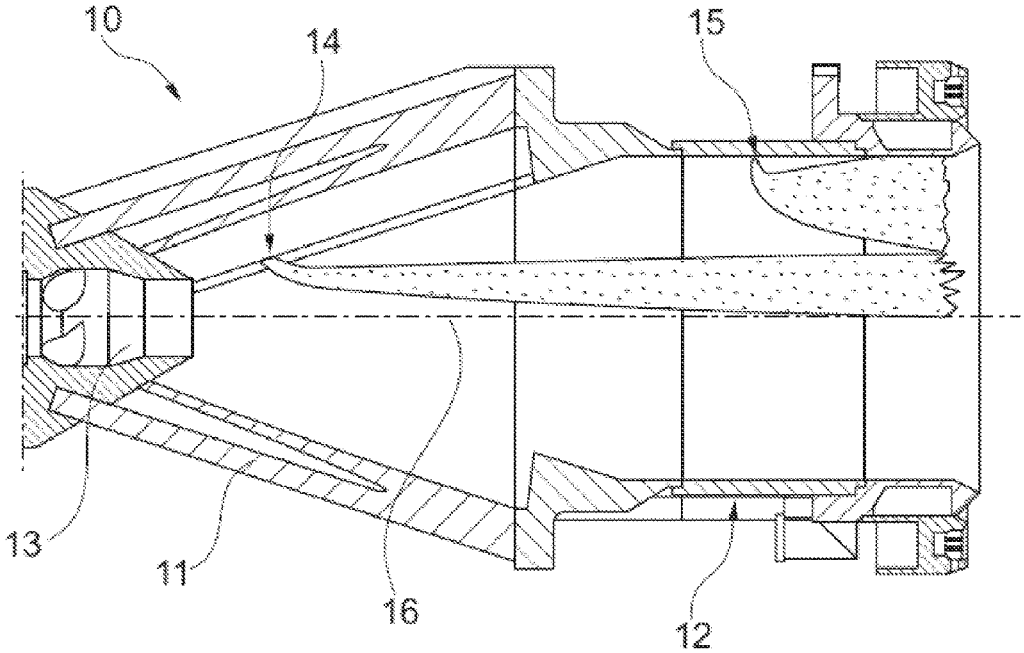
FIG. 1 a longitudinal section through a double-cone burner of the AEV type, for three different kinds of fuel, with an axial injection of a hydrogen-rich, gaseous fuel in stages.

Within the scope of developing lean premix burners for hydrogen-rich fuels, various approaches have been taken with the aim of improving the burners in terms of $NO_x$ emissions and the safeguards against flashback. FIG. 1 shows one of these approaches, in which the hydrogen-rich fuel is injected at different places of the burner. The AEV (Advanced Environmental Vortex) burner 10 shown in FIG. 1 as an example of a double-cone burner has an arrangement consisting of a double cone 11 and a mixing tube 12 downstream along a burner axis 16. Tangential slits in the double cone 11 allow the combustion air to be introduced with a vortex into the interior of the double cone. Natural gas is injected into the combustion air at the double cone 11 in order to obtain a lean premix. Liquid fuel can be injected axially into the burner via a central nozzle 13. The hydrogen-rich fuel (as the third fuel) is injected in the axial direction in stages. This is done in the example shown at two injection sites 14 (in the double cone 11) and 15 (in the mixing tube 12).

In another approach (FIG. 2), which is based on a double-cone burner 20 of the type of an EV (Environmental Vortex) burner for MBtu fuel, hydrogen-rich oil gas (50% $H_2$ and 50% CO) is injected as MBtu fuel 19 into the incoming combustion air 17 at the burner outlet via a plurality of specially configured gas-injection openings 18. Owing to the absence of a mixing zone, diffusion flames having flame fronts 22 are created in the area of the vortex disruption area 21 of the injected air, in which the $NO_x$ content is kept under control by large quantities (about 50%) of diluted $N_2$.

Lean premix burners are fundamentally plagued by re-ignition problems when they are operated with hydrogen-rich fuels. A particular challenge encountered with the lean premix burners that are operated with hydrogen-rich fuels is the need to meet the criterion of "forced re-ignition". Here, a high-energy ignition is employed in an attempt to intentionally cause a re-ignition. If this cannot be done, the burner operation is stable. Up until now, none of the lean premix burners developed for hydrogen-rich fuels has met this criterion.

In an embodiment, the present invention provides a method for the combustion of hydrogen-rich fuels in a lean premix burner of a gas turbine, which avoids the drawbacks of the approaches known so far and provides a high level of safety against re-ignition, and, in another embodiment, a burner for carrying out the method.

The method according to an embodiment of the invention is characterized in that the hydrogen-rich, gaseous fuel is injected at least partially isokinetically with respect to the combustion air, that is to say, partially in the same direction and at the same velocity as the combustion air.

The phrase "partially isokinetic injection" refers to injection that, under the practical boundary conditions of a burner chamber, approximates an injection in the direction and at the velocity of the combustion air. In practical terms, partially isokinetic injection refers to injection at the velocity of the combustion air±50%. Typically, the isokinetic injection is performed at the velocity of the combustion air±20%.

In particular, the isokinetic injection takes place at a high burner load, that is to say, at high mass flow rates of the fuel gas and at high hot-gas temperatures close to the design point. In conventional premix burners for gas turbines, the fuel gas is typically injected at a velocity that is at least twice as high as the velocity of the combustion air.

When the fuel gas is injected from a wall of a burner, a directional component perpendicular to the wall surface is needed, even with isokinetic injection. Injection perpendicular to the wall surface or to the flow, however, is avoided. The angle between the direction of injection and the vertical is kept≥20° for the isokinetic injection. As long as a sufficient penetration depth of the fuel gas into the combustion air can be achieved, an angle of 30° to 50° is selected. The injection vector here is slanted by≥20° from the vertical in the flow direction. Typically, the deviation of the velocity component of the fuel gas and of the combustion air in the plane of the burner wall should amount to less than±20°. A deviation of less than±10°, for example, is achieved in the design point.

With isokinetic injection from the trailing edge of a part, the deviation between the injection direction and the flow direction of the combustion air in each plane can be less than±20°. In the design point, a deviation of less than±10° is achieved, for example, for each plane.

Isokinetic injection can be employed in burners with a vortex flow such as, for instance, in a double-cone burner, as well as in burners with a vortex-free through-flow.

Another embodiment of the method according to the invention is characterized in that the hydrogen-rich, gaseous fuel is injected into the combustion air through elongated rounded openings in a partially isokinetic manner. Here, the main axis of each of the elongated rounded openings is oriented parallel to the local air flow, and the hydrogen-rich, gaseous fuel is injected through the elongated rounded openings at a slant that, vis-à-vis the vertical of the vortex air flow, is oriented in the direction of the vortex air flow. In particular, the slant here is≥20°. As long as a sufficient penetration depth of the fuel gas into the combustion air can be achieved, an angle of 30° to 50° is selected. For the isokinetic injection, the velocity component of the injection of the fuel gas parallel to the plane of the burner wall should ideally be identical to the velocity component of the combustion air in this plane. Deviations cannot be avoided in actual practice. For instance, they can occur during operation at partial load due to changes in the velocity direction of the combustion air. Typically, the deviation of the velocity component of the fuel gas and of the combustion air in the plane of the burner wall should amount to less than±20°. A deviation of less than±10°, for example, is achieved in the design point. Accordingly, a perfect orientation cannot be ensured for all operating states when it comes to the orientation of the main axis of the elongated rounded opening. The deviation between the flow direction and the orientation of the main axis should be less than±20°. A deviation of less than±10°, for example, is achieved in the design point.

An elongated rounded opening is an opening that has an extension in one direction that is greater than in a second direction oriented perpendicular thereto. A slot or an oval are examples of an elongated rounded opening. As a special configuration of an oval, the elongated rounded opening can be configured as an ellipsis. Typically, the elongated rounded openings are configured with an axis of symmetry in their greatest longitudinal extension. They have a so-called main axis that extends in the greatest longitudinal direction and a secondary axis that extends at a right angle to the main axis. The main axis is typically also an axis of symmetry of the elongated rounded opening.

A further improvement can be attained in that the burner wall is effusion-cooled directly downstream from the elongated rounded openings by numerous effusion holes.

One embodiment of the method according to the invention is characterized in that the hydrogen-rich, gaseous fuel is injected through elongated rounded openings in a partially isokinetic manner into the vortex air flow of the combustion air of a double-cone burner. Here, the main axis of the elongated rounded openings is oriented parallel to the local vortex air flow. The hydrogen-rich, gaseous fuel is injected through the elongated rounded openings, for instance, at a slant that, vis-à-vis the vertical of the vortex air flow, is oriented in the direction of the vortex air flow. In particular, the slant here is≥20°. As long as a sufficient penetration depth of the fuel gas into the combustion air can be achieved, an angle of 30° to 50° is selected. For the isokinetic injection, the velocity component of the injection of the fuel gas in the plane of the burner wall should ideally be identical to the velocity component of the combustion air in the plane of the burner wall. Deviations cannot be avoided in actual practice. For instance, they can occur during operation at partial load due to changes in the velocity direction of the combustion air. Typically, the deviation of the velocity component of the fuel gas and of the combustion air in the plane of the burner wall should amount to less than±20°. A deviation of less than±10°, for example, is achieved in the design point. Accordingly, a perfect orientation cannot be ensured for all operating states when it comes to the orientation of the main axis of the elongated rounded opening. The deviation between the flow direction and the orientation of the main axis should be less than±20°. A deviation of less than±10°, for example, is achieved in the design point.

The ratio of the main axis to the secondary axis of the elongated rounded openings is greater than 2:1. A range of 2:1 to 5:1 can be readily achieved in actual practice. In a typical embodiment, the ratio of the main axis to the secondary axis of the elongated rounded openings is 3:1.

Typically, the cross-sectional surface area of the elongated rounded openings corresponds to the cross-sectional surface area of circular openings having a diameter between 2 mm and 6 mm.

In particular, the elongated rounded openings are arranged in the vicinity of the outlet of the double cone. In this context, the vicinity of the outlet comprises, for example, the rear one-third of the lengthwise extension of the burner as seen in the direction of the main flow; typically, the vicinity is even restricted to the rear one-fifth of the burner.

A further improvement can be achieved in that the double cone is effusion-cooled directly downstream from the elongated rounded openings by numerous effusion holes.

Another embodiment of the invention is characterized in that the hydrogen-rich, gaseous fuel is injected into the vortex air flow through elongated rounded openings in a fuel lance that projects into the interior of the double cone in the axial direction. The fuel lance is typically configured as a so-called long fuel lance. This is a lance which extends at least into the half of the double cone that is far way from the flow.

Within the scope of the invention, it is also conceivable for a mixing tube to be arranged in the axial direction downstream from the double cone and for the hydrogen-rich, gaseous fuel to be injected into the vortex air flow through elongated rounded openings in the wall of the mixing tube.

Another embodiment of the method according to the invention is characterized in that the hydrogen-rich, gaseous fuel is injected isokinetically with respect to the combustion air, that is to say, in the same direction and at the same velocity.

In this context, the combustion air preferably enters the interior of the double cone through air slits in the double cone, and the hydrogen-rich, gaseous fuel is injected isokinetically into the incoming combustion air in the area of the air slits.

Advantageously, the isokinetic injection can take place by means of a comb injector. A comb injector is a hollow element having essentially the structure of a comb through which the fuel gas is introduced and distributed, and also having hollow teeth extending from this hollow element, through which the fuel gas is conveyed to the injection openings at the ends of the teeth. Instead of individual teeth, the comb injector can be a hollow element that tapers like a wedge and that, on the side of the tip of the wedge, has a row of injection openings through which the fuel gas is injected. The structure of this embodiment corresponds in principle to that of the trailing edge of an air-cooled turbine blade having cooling-air holes on the trailing edge of the turbine blade. In the flow pattern, the row of fuel gas streams that exit from the injection openings then looks like the teeth of a comb. In order to carry out an isokinetic injection, the comb injector is oriented parallel to the direction of flow of the combustion air, whereby the teeth point in the direction of flow. However, it is likewise conceivable for the isokinetic injection to take place by means of a piggyback injector that is placed on top of the double cone. An example of a piggyback injector is a hollow element that has been placed on the side of the air feed on a half shell of a double cone, through which the fuel gas is then fed. This hollow element tapers like a wedge in the direction of flow. Fuel gas is isokinetically injected into the combustion air via a row of injection openings from the downstream edge. Analogously to the trailing edge of an air-cooled turbine blade having cooling-air holes on the trailing edge of the turbine blade, the trailing edge of the half shell facing downstream can also be configured with injection openings.

The burner according to an embodiment of the invention is characterized in that the burner has means to partially isokinetically or isokinetically inject a hydrogen-rich, gaseous fuel into the combustion air entering the double cone, and in that the injection means are connected to a source of fuel that supplies hydrogen-rich, gaseous fuel.

One embodiment of the burner according to the invention is characterized in that the means to partially isokinetically or isokinetically inject a hydrogen-rich, gaseous fuel into the combustion air entering the burner comprise elongated rounded openings, in that the main axis of each of the elongated rounded openings is oriented parallel to the local air flow, and in that the elongated rounded openings or lines and/or perforations or holes leading to the elongated rounded openings are configured in such a way that the hydrogen-rich, gaseous fuel is injected through the elongated rounded openings at a slant that, vis-à-vis the vertical of the local vortex air flow, is oriented in the direction of the vortex air flow. For this purpose, for example, the perforations or holes through which the fuel gas is conveyed through the burner wall to the elongated rounded openings are configured with a slant or at an angle to the normal of the burner wall.

As an alternative, for instance, feed lines are suitable which pass through the burner wall at an orientation normal to the burner surface and which are configured with a deflection in the area of the elongated rounded openings.

Preferably, the slant is≥20°. The ratio of the main axis to the secondary axis of the elongated rounded openings is greater than 2:1. A range of 2:1 to 5:1 can be readily achieved in actual practice. In a typical embodiment, the ratio of the main axis to the secondary axis of the elongated rounded openings is 3:1.

In an embodiment, the cross-sectional surface area of the elongated rounded openings corresponds to the cross-sectional surface area of circular openings having a diameter between 2 mm and 6 mm.

According to another embodiment, the elongated rounded openings are arranged in the vicinity of the outlet of the burner.

In one embodiment, the burner according to the invention is a double-cone burner. The double-cone burner according to the invention is characterized in that the double-cone burner has a double cone as well as means to partially isokinetically or isokinetically inject a hydrogen-rich, gaseous fuel into the combustion air entering the double cone, and in that the injection means are connected to a source of fuel that supplies hydrogen-rich, gaseous fuel.

One embodiment of the double-cone burner according to the invention is characterized in that the means to partially isokinetically or isokinetically inject a hydrogen-rich, gaseous fuel into the combustion air entering the double cone comprise elongated rounded openings, in that the main axis of each of the elongated rounded openings is oriented parallel to the local vortex air flow, and in that the elongated rounded openings are configured in such a way that the hydrogen-rich, gaseous fuel is injected through the elongated rounded openings at a slant that, vis-à-vis the vertical of the vortex air flow, is oriented in the direction of the vortex air flow.

Preferably, the slant is≥20°. The ratio of the main axis to the secondary axis of the elongated rounded openings is greater than 2:1. A range of 2:1 to 5:1 is advantageous in actual practice. In a typical embodiment, the ratio of the main axis to the secondary axis of the elongated rounded openings is 3:1.

Typically, the cross-sectional surface area of the elongated rounded openings corresponds to the cross-sectional surface area of circular openings having a diameter between 2 mm and 6 mm.

According to another embodiment, the elongated rounded openings are arranged in the vicinity of the outlet of the double cone.

According to another embodiment, the elongated rounded openings are arranged in the vicinity of the outlet of a mixing tube of a double-cone burner that adjoins the double cone.

Another embodiment of the double-cone burner according to the invention is characterized in that the double cone has air slits for the combustion air to enter the interior of the double cone, and in that the means to partially isokinetically or isokinetically inject a hydrogen-rich, gaseous fuel into the combustion air entering the double cone comprise a plurality of tangentially oriented fuel nozzles arranged in the area of the air slits.

Here, the fuel nozzles are preferably part of a comb injector or of a piggyback injector that is placed on top of the double cone.

Furthermore, it is also possible to provide a fuel lance that projects into the interior of the double cone and that has elongated rounded openings in the axial direction.

Within the scope of the invention, the term combustion air refers not only to pure combustion air but also to a mixture of air and re-circulated exhaust gases, or to an air mixture mixed with inert gas.

Experiments with injection devices that resist a forced re-ignition have shown that there are numerous configuration features that prevent anchoring of hydrogen-rich flames when fuels are injected into a crosswise flow. The design rules demonstrate that the partially isokinetic injection of fuel is best suited for meeting the criteria based on forced re-ignition. Fuel injection which is done in the same direction and which also has an injection velocity that is similar to that of the local combustion-air flow is the safest injection method for hydrogen-rich fuels.

Consequently, the solution for the problems outlined above lies in applying these design rules to conical burners, especially to double-cone burners of the EV or AEV type. In this context, there are two main methods for transferring these rules to conical burners. One method aims at a re-ignition-proof diffusive burner for hydrogen-rich fuels wherein $H_2$>>50%. The other method allows a re-ignition-proof, purely premix operation with hydrogen-rich fuels with a low $NO_x$ emission and slight dilution.

Figure 2:
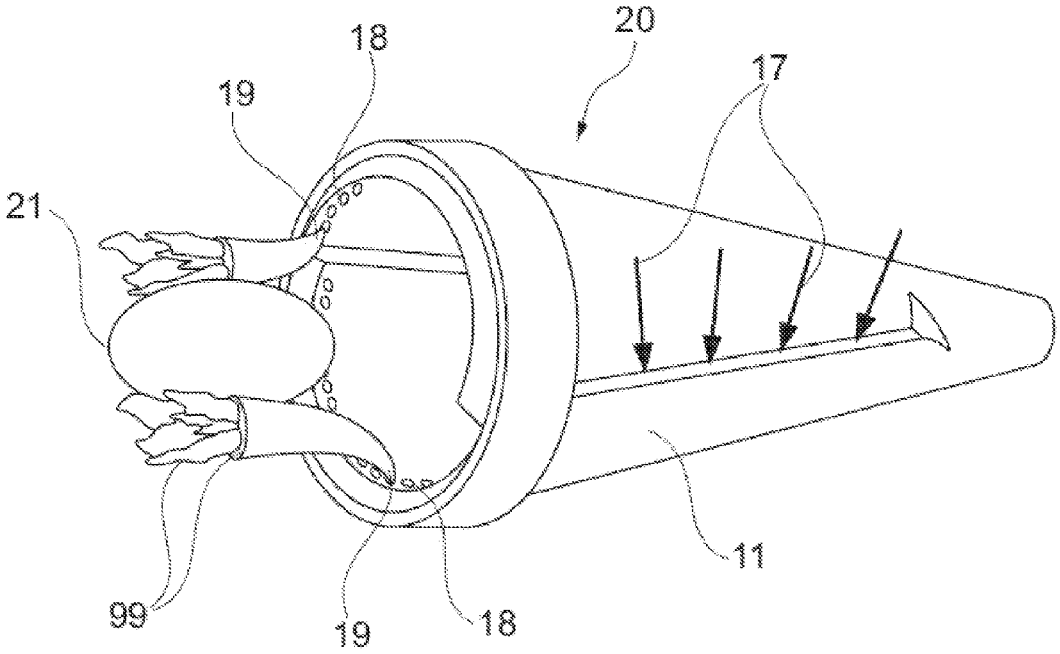
FIG. 2 a perspective side view of a burner for MBtu fuel, having round gas-injection openings on the burner outlet for injecting hydrogen-rich, gaseous fuel.
Figure 3:
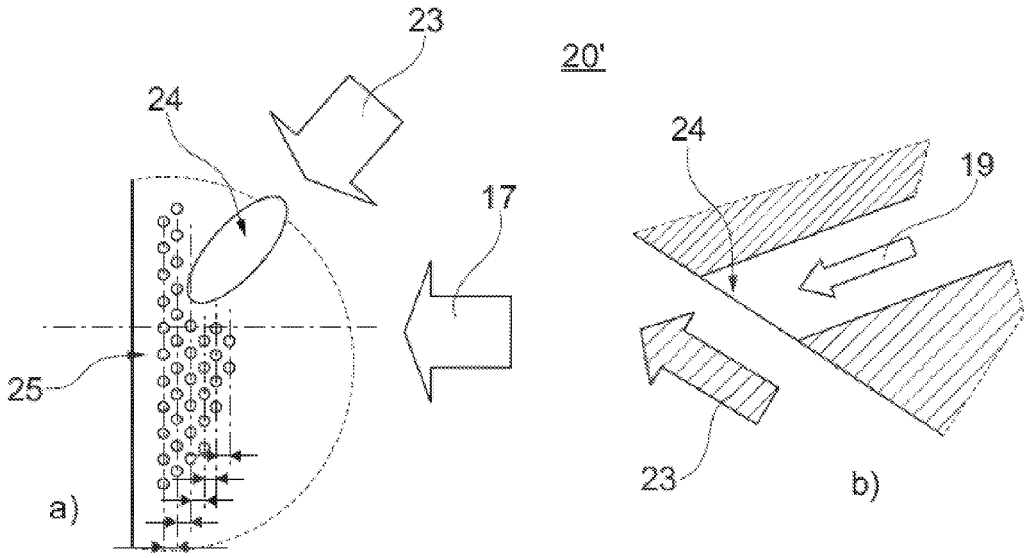
FIG. 3 a section of a top view (FIG. 3*a*) and a sectional view (FIG. 3*b*) showing an elliptical opening for partially isokinetically injecting hydrogen-rich, gaseous fuel, which is provided instead of the round gas-injection openings in the burner for MBtu fuel according to FIG. 2.

On the basis of a burner for MBtu fuel, as shown in FIG. 2, the forced re-ignition criterion for operation with hydrogen-rich fuel wherein $H_2$>>50% can be met in that the gas-injection openings 18 in FIG. 2 are replaced by elongated rounded openings, for instance, elliptical openings. Such an elliptical opening 24 is depicted in the double-cone burner 20' of FIG. 3 in a top view (FIG. 3*a*) as well as in a sectional view (FIG. 3*b*). The elliptical openings 24 are characterized by the following characteristic properties:

- the ratio of the main axis to the secondary axis is about 3:1.
- the main axis is oriented towards the local vortex air flow 23 that is formed by the double cone from the inflowing combustion air 17.
- the cross-sectional surface area of the elliptical openings 24 corresponds to the cross-sectional surface area of the circular openings having a diameter between 2 mm and 6 mm.
- the fuel is injected through the elliptical openings in a direction that is oriented at a slant≥20° that, vis-à-vis the vertical of the vortex air flow, is oriented in the direction of the vortex air flow. The greater this deviation from the vertical, the more isokinetic the injection.

In the final analysis, this type of injection constitutes an injection into a crosswise flow. However, it can also be referred to as "partially isokinetic" since, due to the slant, to the shape and to the dimensions of the opening, the interaction between the fuel jet and the crosswise flowing air is minimized at the injection point, as a result of which recirculation and stagnation zones as well as initial shear stresses are minimized.

It has also been found that effusion cooling directly downstream from the elongated rounded openings 24 considerably reduces the tendency of the injectors to hold the flame. This is done by means of appropriate finely distributed outflow holes 25 of the type depicted in FIG. 3*a*. Effusion cooling allows the use of larger fuel jets, which translates into greater penetration depths, better mixing and less $NO_x$ (as well as less dilution by $N_2$ or steam).

Figure 4:
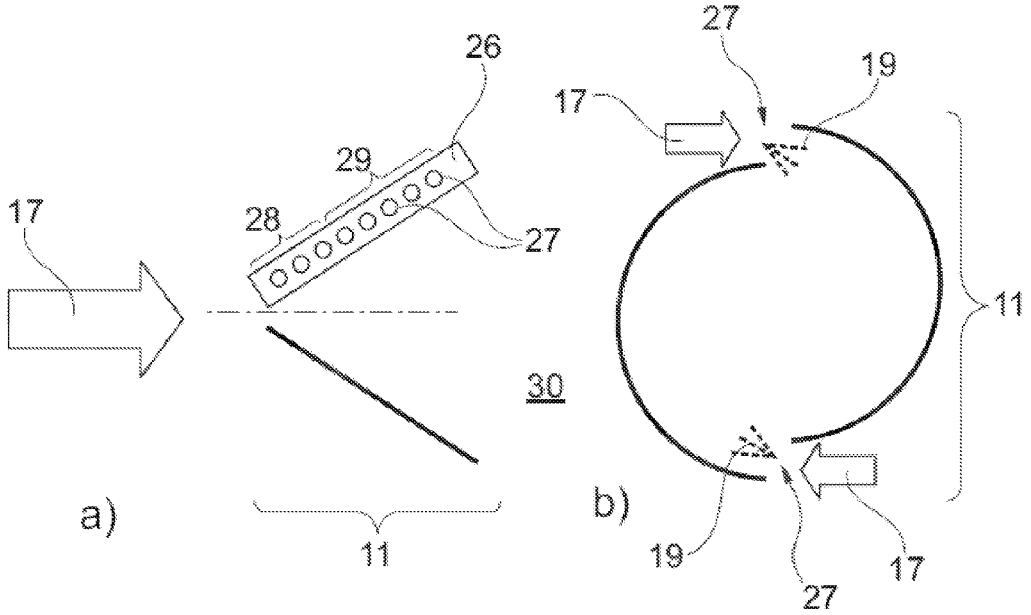
FIG. 4 a side view (FIG. 4*a*) and an upstream view (FIG. 4*b*) of an embodiment of the isokinetic injection of hydrogen-rich, gaseous fuel.

With another injection method, the fuel is injected into the air slits of a double-cone burner (e.g. of the EV or AEV type), whereby the injection direction is oriented precisely towards the local air flow, and the injection velocity is in the same order of magnitude as the local flow velocity of the air (see FIG. 4). In this context, several fuel nozzles 27 are arranged in a row in the air slit 26 of the double cone 11 of the double-cone burner 30. Such a purely isokinetic injection ensures that:

- air carries the fuel away from all metallic surfaces, and the fuel is not trapped in the small (nevertheless of significance for the hydrogen) vortices behind the relatively wide trailing edges of the vortex element;
- the shear stresses are minimized (in order to reduce the spreading of fuel near the walls of the vortex element); and
- no strong fuel jets are present which could interact with the air and form wake vortices and stagnation zones where the fuel can be trapped and self-ignite.

It is also recommended for the hydrogen-rich fuel to be injected in stages (in the present example of FIG. 4, two stages 28 and 29 are present). This approach ensures that the fuel injection takes place virtually isokinetically over the entire load area, while also increasing the flexibility of the operation.

Figure 5:
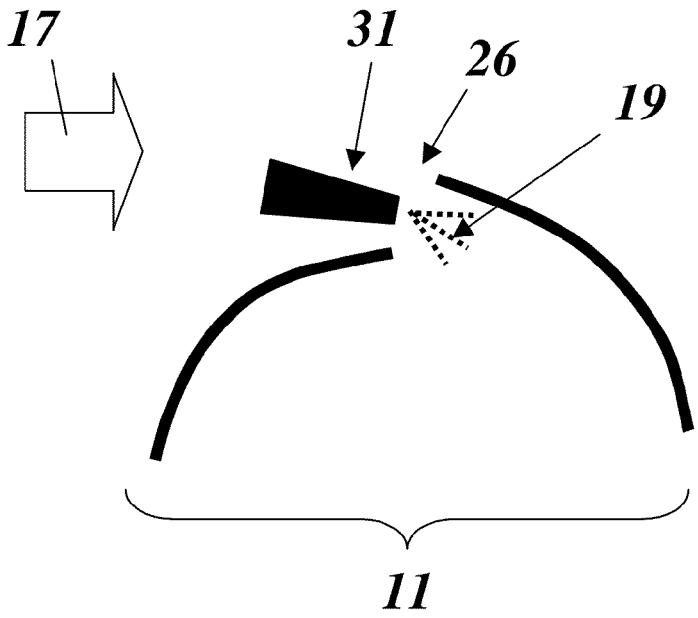
FIG. 5 the isokinetic injection according to FIG. 4, by means of a comb injector.
Figure 6:
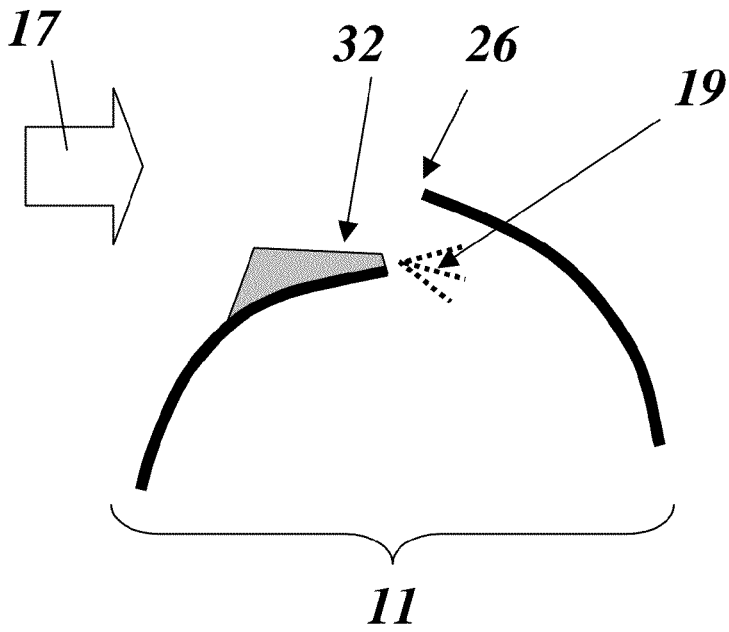
FIG. 6 the isokinetic injection according to FIG. 4, by means of a piggyback injector.

FIGS. 5 and 6 show two ways to attain the desired isokinetic injection: in the first case (FIG. 5), a comb injector 31 is employed to inject the hydrogen-rich fuel 19 from the middle of the air slit 26. In the second case (FIG. 6), a piggyback injector 32 is placed onto the outer surface of the shell of the double cone 11. In a variant, however, the fuel to be injected can also be introduced directly through a plenum integrated into the shell of the double cone 11 and it can be injected through the trailing edge of the shell.

If the fuel jets are not perfectly oriented towards the local air flow, then elliptical openings according to FIG. 3 should be used here as well.

Due to the injection according to the invention of the hydrogen-rich fuel, the burner parts used for the premixing of natural gas and for the injection of liquid fuels such as oil, remain unaffected, so that the burners can operate as three-fuel burners.

It is also possible to use the described partially isokinetic injection (FIG. 3) and the isokinetic injection (FIGS. 4 to 6) of hydrogen-rich fuels in other types of burners for hydrogen-rich fuels, including SEV burners for intermediate superheating in gas turbines.

Figure 7:
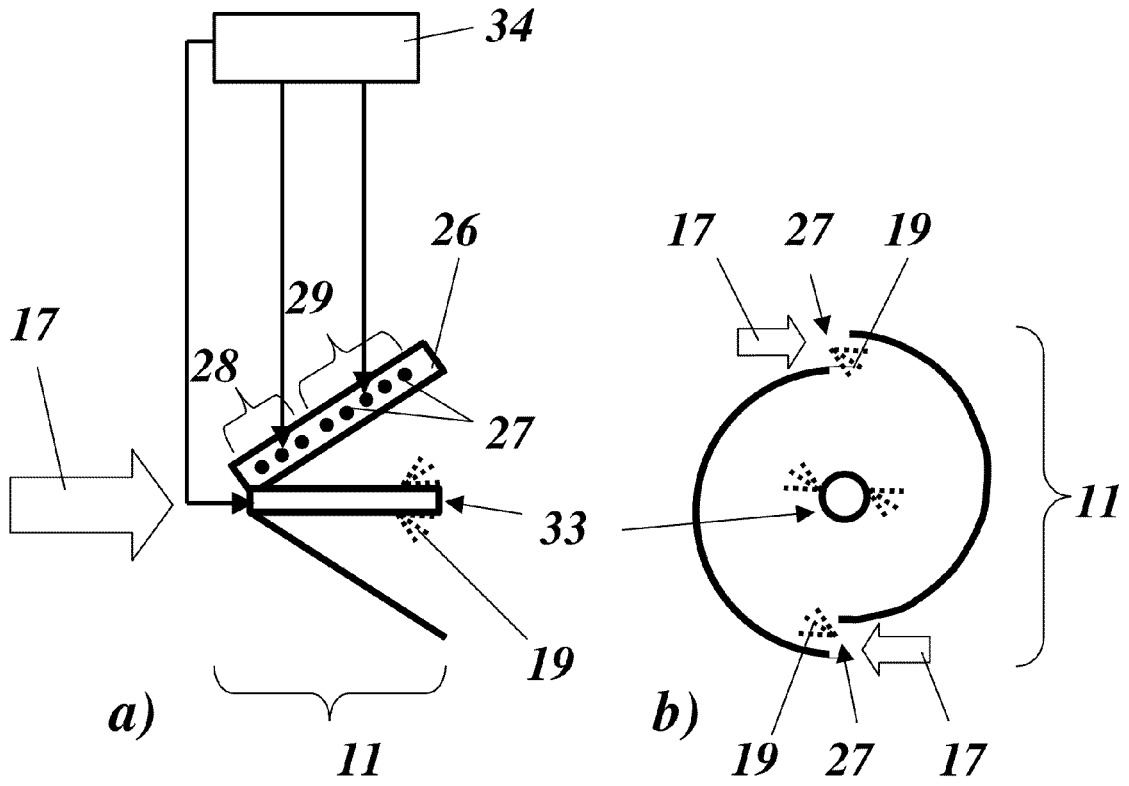
FIG. 7 a side view (FIG. 7*a*) and an upstream view (FIG. 7*b*) of another embodiment of the isokinetic injection of hydrogen-rich, gaseous fuel, with an additional partially isokinetic injection through elliptical openings in a long fuel lance.

Thus, for instance, as shown in FIG. 7, the hydrogen-rich fuel 19, which is provided by a fuel source 34, can be partially isokinetically injected in a central, long fuel lance 33 via elliptical openings, whereby this injection can serve as another stage or else it can replace the first stage 28 in the air slit 26.

Finally, similar to the case of FIG. 1, the hydrogen-rich fuel can be partially isokinetically injected through elliptical openings in the mixing tube 12 of an appropriate burner.

Figure 8:
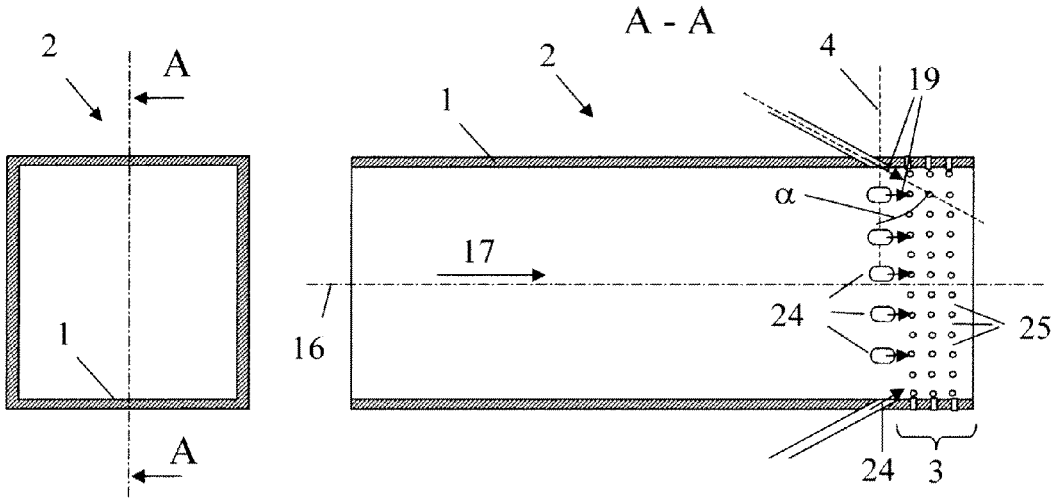
FIG. 8 an embodiment of the isokinetic injection of hydrogen-rich, gaseous fuel through elongated rounded openings in a vortex-free burner.

FIG. 8 shows another embodiment of the isokinetic injection of hydrogen-rich, gaseous fuel 19 via elliptical openings 24 into a vortex-free burner 2. The essential elements of a burner according to the invention are schematically depicted. A top view of the burner in the flow direction is shown on the left-hand side of the figure. In this example, the burner has a simple rectangular flow cross section that is limited by the burner walls 1. The section line A-A shows the lengthwise extension of the burner 2 in the direction of flow. The combustion air 17 flows parallel to the burner axis 16 through the vortex-free burner 2. The hydrogen-rich, gaseous fuel 19 is isokinetically injected into the combustion air 17 via the elongated rounded openings 24 through the burner wall 1 at an angle a relative to the flow normal 4. The flow normal 4 is the vertical to the air flow direction that, in the example, runs parallel to the burner wall. The elongated rounded openings 24 in this example are configured as slots with a length-to-width ratio of about 2:1.

Downstream from the elongated rounded openings 24, for the isokinetic injection of the hydrogen-rich, gaseous fuel, effusion cooling 3 of the burner wall is carried out by a field of effusion holes 25 through which the cooling air is injected.

All of the advantages elaborated upon can be used not only in the combinations given but also in other combinations or on their own, without departing from the scope of the invention. For instance, instead of a rectangular flow cross section, as shown in FIG. 8, it is also possible to select a burner with a circular cross section. The flow through this burner can be either with a vortex or without a vortex.

List of Reference Numerals

1 burner wall
2 vortex-free burner
3 effusion cooling
4 flow normal
10 double-cone burner (AEV burner)
11 double cone
12 mixing tube
13 central nozzle
14, 15 injection site
16 burner axis
17 combustion air
18 gas injection opening
19 MBtu fuel (hydrogen-rich)
20, 20' double-cone burner (EV burner)
21 disruption of the vortex
22 flame front
23 vortex air flow
24 elliptical or elongated rounded opening
25 effusion hole
26 air slit
27 fuel nozzle
28, 29 stage
30 double-cone burner (AEV or EV burner)
31 comb injector
32 piggyback injector
33 fuel lance (long)
34 fuel source
$\alpha$ angle relative to flow normal

The invention claimed is:

1. A method for combustion of a hydrogen-rich, gaseous fuel in combustion air in a double-cone burner of a gas turbine, the method comprising:

injecting the hydrogen-rich, gaseous fuel at least partially isokinetically with respect to the combustion air such that the hydrogen-rich, gaseous fuel is injected at least partially in the same direction and at least partially at the same velocity as the combustion air, wherein the hydrogen-rich, gaseous fuel is injected into the combustion air through one or more elongated rounded openings, wherein a main axis of each of the elongated rounded openings is oriented parallel to a local air flow, and wherein the hydrogen-rich, gaseous fuel is injected through the elongated rounded openings at a slant that, in relation to a vertical of a vortex air flow, is oriented in a direction of the vortex air flow.

2. The method according to claim 1, wherein the slant is≥20°.

3. The method according to claim 1, wherein a ratio of the main axis to a secondary axis of the elongated rounded openings is greater than 2:1.

4. The method according to claim 1, wherein a cross-sectional surface area of the elongated rounded openings corresponds to a cross-sectional surface area of circular openings having a diameter between 2 mm and 6 mm.

5. The method according to claim 1, wherein a wall of the burner is effusion-cooled directly downstream from the elongated rounded openings by a plurality of effussion holes.

6. The method according to claim 1, wherein the combustion air enters an interior of the double-cone burner through air slits of a double cone and forms therein a vortex air flow in an area of the double cone.

7. The method according to claim 6, wherein elongated rounded openings are disposed in a vicinity of an outlet of the double cone.

8. The method according to claim 6, wherein at least a part of the hydrogen-rich, gaseous fuel is injected into the vortex air flow through elongated rounded openings in a fuel lance that projects into the interior of the double cone in an axial direction.

9. The method according to claim 6, wherein a mixing tube is disposed in an axial direction downstream from the double cone, the hydrogen-rich, gaseous fuel being injected into the vortex air flow through elongated rounded openings in a wall of the mixing tube.

10. The method according to claim 6, wherein the hydrogen-rich, gaseous fuel is injected isokinetically with respect to the combustion air such that the hydrogen-rich, gaseous fuel is injected in the same direction and at the same velocity as the combustion air.

11. The method according to claim 10, wherein the combustion air enters the interior of the double cone through air slits in the double cone, the hydrogen-ria, gaseous fuel being injected isokinetically into the combustion air entering the interior of the double cone in an area of the air slits.

12. The method according to claim 11, wherein the injecting the hydrogen-rich, gaseous fuel is performed using a comb injector.

13. The method according to claim 11, wherein the injecting the hydrogen-rich, gaseous fuel is performed using a piggyback injector disposed on top of the double cone.

14. A double-cone burner for combustion of a hydrogen-rich, gaseous fuel in a gas turbine, comprising:

an injection unit configured to at least partially isokinetically inject the hydrogen-rich, gaseous fuel into combustion air flowing through the double-cone burner, wherein the injection unit is connected to a fuel source at supplies the hydrogen-rich, gaseous fuel, wherein the injection unit comprises an elongated rounded opening, and wherein a main axis of the elongated rounded opening is oriented parallel to a local air flow.

15. The burner according to claim 14, wherein the injection unit comprises a perforation, a hole, or a perforation and a hole configured to convey the hydrogen-rich, gaseous fuel through a wall of the burner to elongated rounded openings that are configured with a slant to a normal of the burner wall, such that the hydrogen-rich, gaseous fuel is injected through the elongated rounded openings at a slant of≥20° that in relation to a vertical of a vortex air flow, is oriented in a direction of the vortex air flow.

16. The burner according to claim 14, wherein a ratio of the main axis to a secondary axis of the elongated rounded opening is greater than 2:1.

17. The burner according to claim 14, wherein a cross-sectional surface area of the elongated rounded opening corresponds to a cross-sectional surface area of a circular opening having a diameter between 2 mm and 6 mm.

18. The burner according to claim 14, wherein the elongated rounded opening is configured as an ellipse, oval, or slot.

19. The burner according to claim 14, wherein the injection unit is disposed in a vicinity of an outlet of a double cone of the burner or a vicinity of a mixing tube that adjoins the double cone.

20. The burner according to claim 14, wherein a double cone of the burner includes air slits configured to allow the combustion air to enter an interior of the double cone, the injection unit including a plurality of tangentially oriented fuel nozzles disposed in an area of the air slits.

21. The burner according to claim 20, wherein the fuel nozzles are part of a comb injector.

22. The burner according to claim 20, wherein the fuel nozzles are part of a piggyback injector disposed on top of the double cone.

23. The burner according to claim 14, wherein the injection unit includes a fuel lance that projects into an interior of a double cone of the burner and elongated rounded openings disposed in an axial direction.

24. The burner according to claim 14, wherein a wall of the burner is effusion-cooled directly downstream from the elongated rounded opening by a plurality of effusion holes.

* * * * *